US006715411B1

(12) United States Patent
Boegli

(10) Patent No.: US 6,715,411 B1
(45) Date of Patent: Apr. 6, 2004

(54) DEVICE FOR THE TREATMENT OF FLAT MATERIALS

(75) Inventor: Charles Boegli, Marin (CH)

(73) Assignee: Boegli Gravures S.A., Marin (CH)

( * ) Notice: Subject to any disclaimer, the term of this patent is extended or adjusted under 35 U.S.C. 154(b) by 0 days.

(21) Appl. No.: 09/572,438

(22) Filed: May 17, 2000

(51) Int. Cl.[7] ..... B31F 1/07
(52) U.S. Cl. ..... 101/6; 101/28; 72/196
(58) Field of Search ..... 101/3.1, 4, 5, 32, 101/6, 16, 22, 23, 28; 72/196, 197, 379.2

(56) References Cited

U.S. PATENT DOCUMENTS

| | | | | |
|---|---|---|---|---|
| 4,280,978 A | * | 7/1981 | Dannheim et al. | 264/156 |
| 4,682,540 A | * | 7/1987 | Eastman et al. | 101/32 |
| 5,007,271 A | | 4/1991 | Boegli | 72/196 |
| 5,269,983 A | * | 12/1993 | Schulz | 364/25 |
| 5,590,557 A | * | 1/1997 | Keller et al. | 72/238 |
| 5,598,774 A | | 2/1997 | Boegli | 100/170 |
| 5,598,784 A | | 2/1997 | Kubsik et al. | 104/111 |
| 5,689,990 A | * | 11/1997 | Deeley | 52/630 |

FOREIGN PATENT DOCUMENTS

| | | |
|---|---|---|
| EP | 0 870 712 | 10/1998 |
| EP | 0 925 911 | 6/1999 |
| WO | WO 00/69622 | * 11/2000 |

* cited by examiner

*Primary Examiner*—Ren Yan
(74) *Attorney, Agent, or Firm*—Foley & Lardner

(57) ABSTRACT

The device for embossing and/or calendering foils comprises at least one first and one second embossing roll between the flat material is passed under pressure in order to produce a pattern. The second embossing roll is followed by at least another embossing roll which cooperates with the first or the preceding embossing roll and between which the patterned flat material is passed in order to receive essentially the same pattern in a re-embossing procedure. In the case of complex treatments, it is advantageous to synchronize the embossing rolls. Particularly in the case of paper having a thin metallization, the following additional embossing roll which re-embosses the pattern allows to avoid higher contact pressures causing increased wear, and a substantially improved folding behavior is obtained.

17 Claims, 5 Drawing Sheets

DEVICE FOR THE TREATMENT OF FLAT MATERIALS

FIELD OF THE INVENTION

The present invention refers to a device for the treatment of flat materials, more particularly for embossing and/or calendering foils, comprising at least one first and one second embossing roll, one of these rolls being driven and one of these rolls being free-wheeled, between which rolls the flat materials are passed under pressure in order to produce a pattern. A device of this kind is e.g. known from U.S. Pat. No. 5,007,271 or U.S. Pat. No. 5,598,774 of the same applicant. In particular, the flat materials in question are bands or strips one face of which is coated with metal, generally with aluminum, and whose support consists of paper or another fibrous material, or foils, e.g. of synthetic materials, of metal, or of compound materials.

BACKGROUND OF THE INVENTION

The above-mentioned embossing devices are e.g. used in the packaging industry for the purpose of embossing packing materials while seals, devices, etc. may be stamped at the same time. In this context, the term embossing means providing the surface with a fine pattern in the millimeter or submillimeter range. Strip or sheet packing materials of this kind are e.g. used for the packaging of tobacco products, cigarettes, foods, chocolates, chewing gums, and the like.

The devices mentioned in the introduction have been successful and still are as long as the embossed foils, more particularly packaging foils, are mainly composed of aluminum or mainly of easily foldable paper. In the production of cigarette packages, for example, these packaging materials serve the purpose of wrapping up a counted number of cigarettes in order to be subsequently inserted in a box.

In order to be able to meet the increasingly severe environmental prescriptions, the embossing materials have been modified in the sense that the thickness of the metallized layer of the embossed media, e.g. metallized paper, has been reduced while simultaneously reinforcing the fibers to such an extent that the favorable folding properties have sensibly deteriorated.

In the operation of the cited devices, it is observed that the paper nerves of embossed papers having stronger fibers are no longer sufficiently broken by conventional embossing techniques, and that after the folding process, a so-called memory effect is observed as the folded portions tend to return to their original condition. The insertion of cigarette packaging units wrapped up in the new packing materials is thereby impaired or sometimes impossible. The above-mentioned effect further increases if the embossing paper loses humidity due to inadequate storage, thereby further increasing the strength of the paper fibers. This could be encountered by thermal treatments and controlled humidification of the media prior to folding resp. embossing, but for the packaging of foods, chewing gums, cigarettes, etc., it is not advantageous for hygienic reasons. In some cases, however, it may be advantageous if the embossed paper is smoothened by a subsequent roll.

In order still to be able to process such difficultly foldable materials, the contact pressure of the embossing rolls used according to the cited references is sometimes substantially increased as compared to the previously used standard media. However, the result is an important reduction of the tool life of the embossing rolls, and besides the costs for replacement parts, the necessary maintenance requires an interruption of the production, thereby reducing the overall efficiency and thus the productivity.

A parallel development is that in the quality inspection of the end users, the tolerance range of the media delivered by the paper manufacturers has been substantially restricted. The reason is that the embossing pressure, i.e. the contact pressure of the mating roll on the driven roll, has to be substantially further increased in order to always ensure a sufficient stamping if the variations in thickness are too large. Due to the higher demands in quality, the number of possible suppliers has been strongly limited, resp. the manufacture of the paper becomes more complicated.

SUMMARY OF THE INVENTION

It is the object of the present invention to improve the quality of the embossing and calendering as well as the folding behavior of the processed foil over the prior art without increasing the embossing pressure and thus the wear of the embossing rolls. This object is attained by a device wherein the second embossing roll is followed by at least another embossing roll which cooperates with the first or the preceding embossing roll and between which the patterned flat material is passed in order to receive essentially the same pattern in a re-embossing procedure.

According to the solution disclosed in claim 1, it has been found surprisingly that the presence of at least one following embossing roll for re-embossing the material not only allows a substantial reduction of the contact pressures, e.g. by half, but also a substantial improvement both of the optical properties of the embossed materials and of their folding properties.

Further embodiments and improvements of the device of the invention are described in the dependent claims.

BRIEF DESCRIPTION OF THE DRAWINGS

The invention is explained in more detail hereinafter with reference to a drawing of exemplary embodiments.

DETAILED DESCRIPTION OF THE INVENTION

Figure 1:
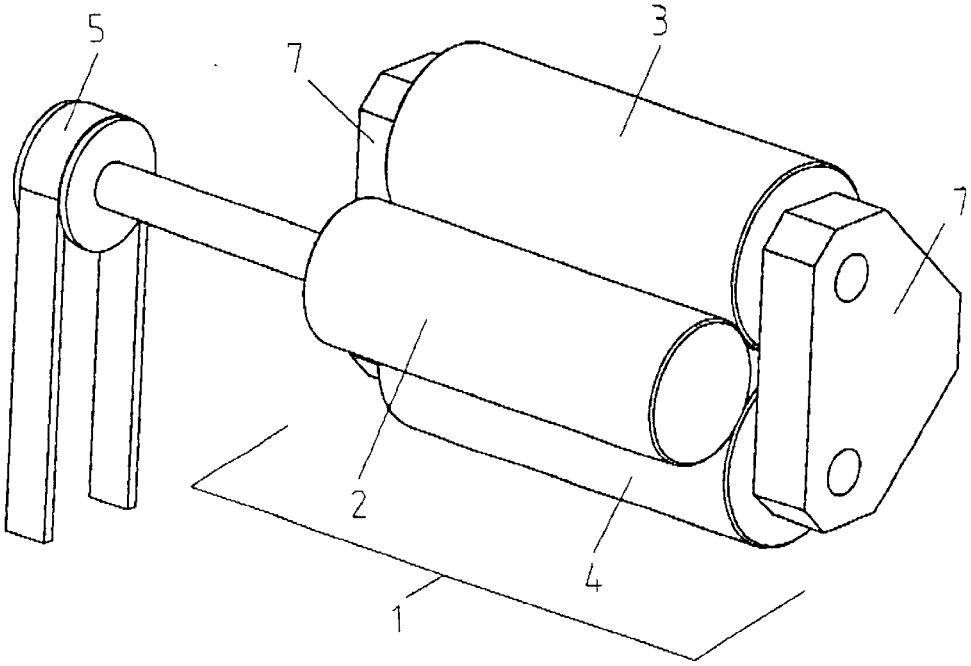
FIG. 1 shows a schematic perspective view of a first embodiment of the invention.
Figure 2:
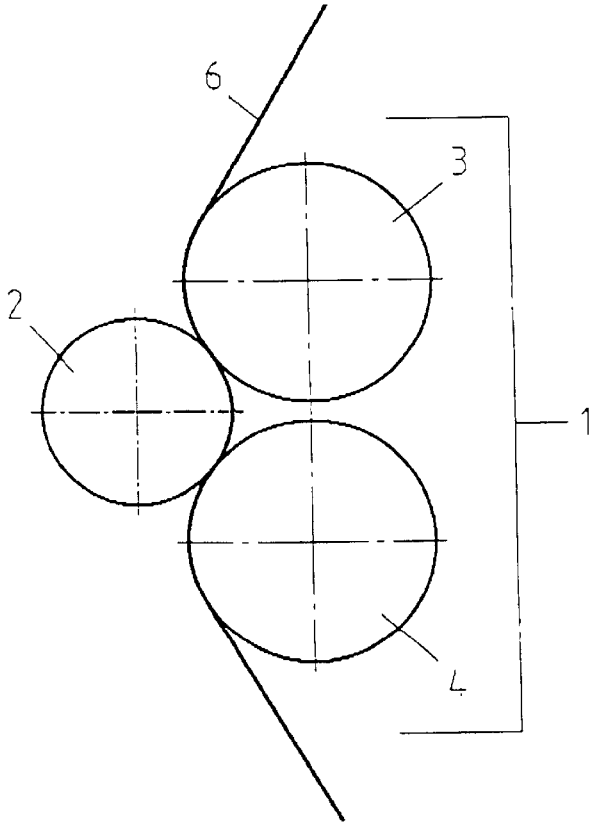
FIG. 2 shows a schematic cross-section of the device of FIG. 1 with the embossed medium.

FIG. 1 shows a first exemplary embodiment of a device 1 with the devices which are essential for the invention, i.e. a first embossing roll 2 which cooperates with a second embossing roll 3 and a following embossing roll 4, the first roll 2 being driven by a driving system 5 while the two other rolls 3 and 4, i.e. the mating rolls, are neither driven themselves nor synchronized with the driven roll by means of synchronizing elements such as e.g. gearwheels, but driven by medium 6, see FIG. 2.

As FIG. 2 schematically shows, the embossed medium 6, e.g. paper with a thin metallized layer of 0.006 mm, runs in the vertical direction, i.e. from the top to the bottom of the figures.

In FIG. 1 and 2, the embossing rolls are illustrated with smooth surfaces in order to indicate that they may be provided with different structures. An advantageous structure is e.g. a toothing according to first mentioned U.S. Pat. No. 5,007,271 or the improved embodiment according to the European Patent Application No. 98811220.7.

With respect to the re-embossing procedure, which is not a supplementary embossing procedure where different patterns are embossed successively to produce a final pattern, it is important to note that all embossing rolls have toothings of the same kind and the same dimensions such that in the stable mutual position, each tooth of each roll is symmetrically enclosed between four teeth of the opposite roll.

The production of devices, emblems and the like, hereinafter called patterns, is realized by removing or shortening the teeth at the desired locations, and these engravings may be produced either on a single roll, e.g. the driven roll, or on different rolls. The engravings on the mating rolls may be the same or varied, and the area of the pattern on the first mating roll may be somewhat larger than on the following roll or rolls, i.e. the sharp contours are produced by the following roll(s).

Toothings of the same kind on all cooperating embossing rolls for the re-embossing procedure are not only used in the case of pyramidal teeth which are disposed in parallel and orthogonally to the longitudinal axis, but for teeth of all kinds in any disposition.

FIGS. 1 or 2 indicate that the two mating rolls 3 and 4 are in engagement with driven roll 2, but this is not necessarily always the case. It is also possible that the second resp. additional roll is in engagement or capable of being engaged with the first, resp. preceding roll only. Also, it may be advantageous in certain applications to provide more than three embossing rolls altogether, in which case all of them have toothings of the same kind. Furthermore, the rolls may be different both with respect to their diameters and their lengths. Soft rolls may also be used in addition to the embossing rolls.

While driven roll 2 is fixedly journalled, at least one of the two mating rolls is free-wheeling and journalled as described in U.S. Pat. No. 5,598,774. This means that the axles of the embossing rolls are capable of an excursion both in the longitudinal and/or in the pressure direction of the material. This allows an adjustment of the rolls and a precise engagement of the teeth in each other, and thus a faultless treatment of the material without wrinkling it. Further, since the teeth of the embossing rolls precisely engage each other (i.e., intermesh), the driven and free wheeled rolls self-synchronize as described in U.S. Pat. No. 5,598,774.

The remaining driving elements and the constructive details are described in the cited U.S. Patent Application U.S. Pat. No. 5,598,774, although in the present example, the material passes through the machine in the vertical direction. In FIG. 1, the bearings, resp. the two yokes 7 which contain the two bearings, are schematically illustrated. At the same time, it is thereby indicated that the roll axles may be journalled individually, in groups, or in common.

The use of follow-up rolls and the reduction of the contact pressure completely eliminate the need of providing a complicated flexural compensation for the embossing rolls.

Figure 3:
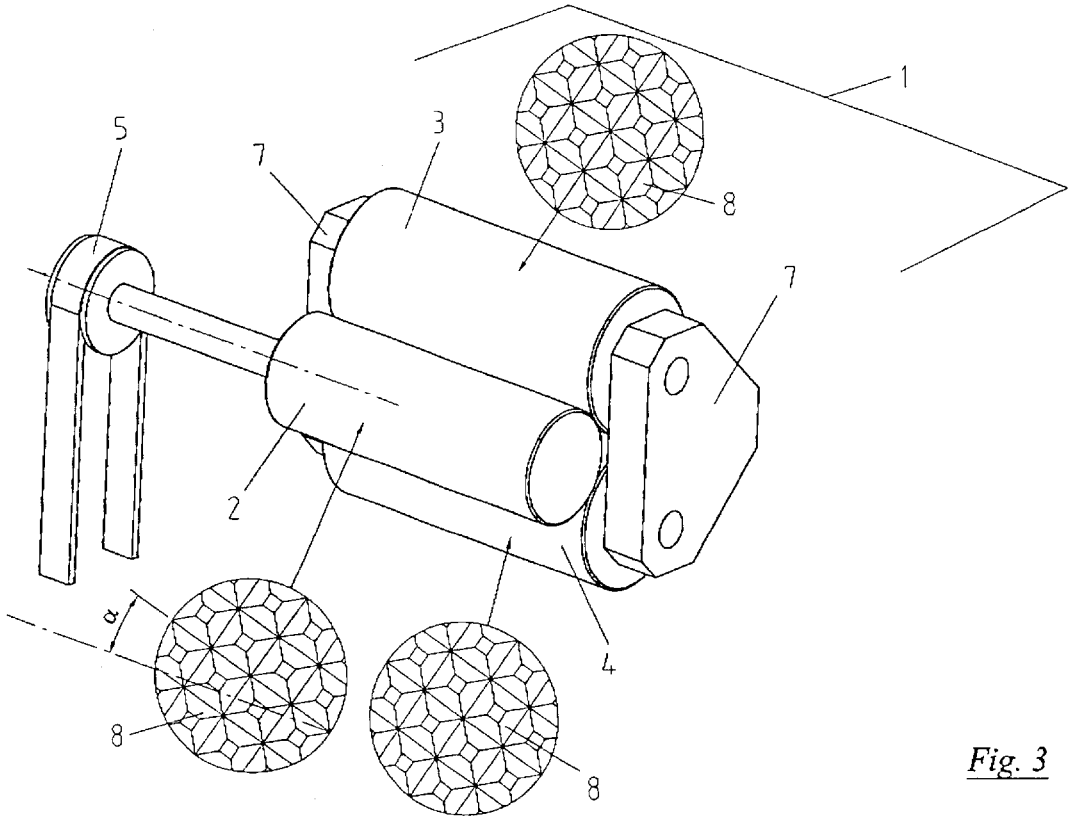
FIG. 3 shows a second embodiment of the device of the invention comprising a synchronization gear.
Figure 4:
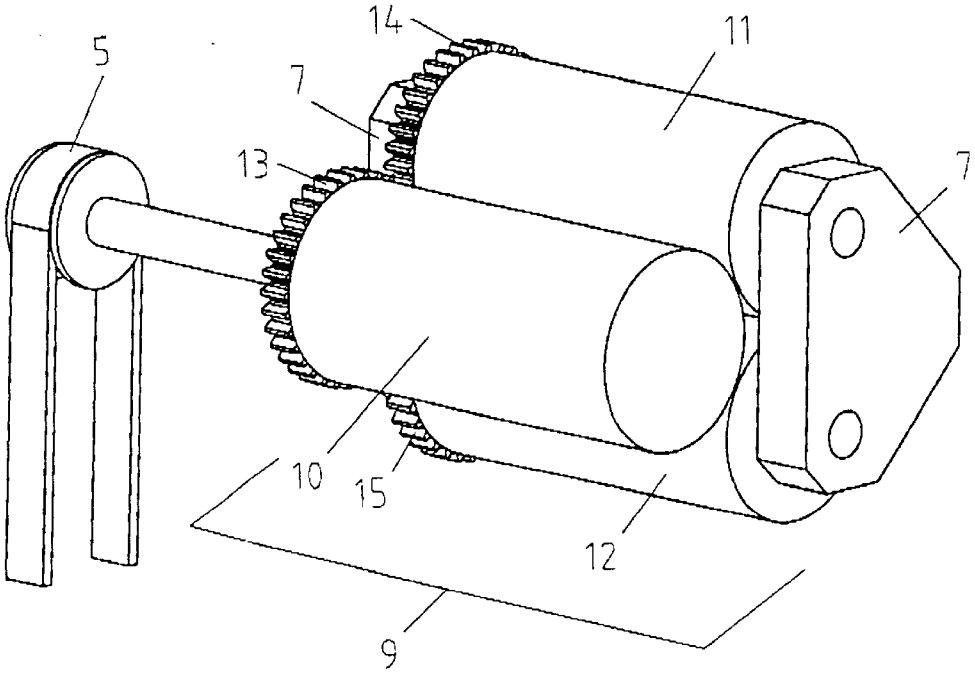
FIG. 4 shows a perspective view of a second embodiment of the invention.
Figure 5:
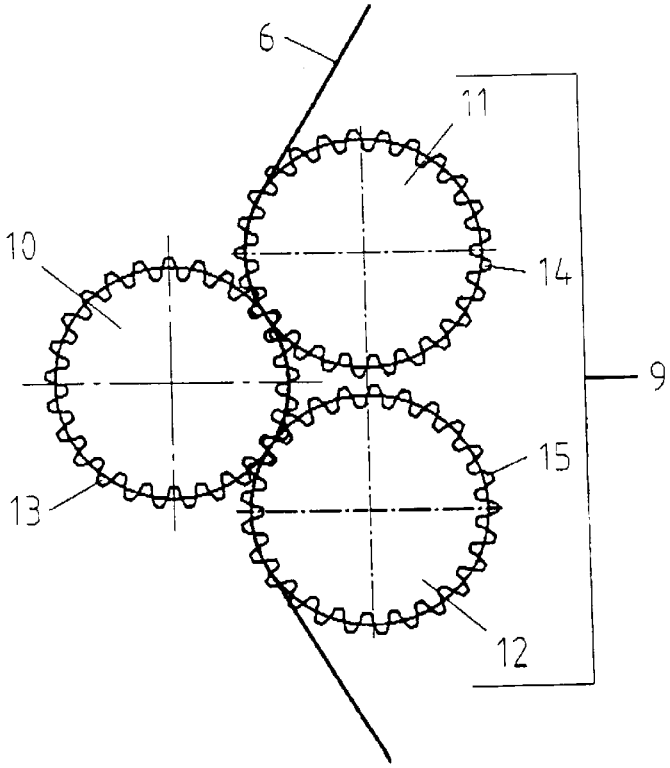
FIG. 5 shows a cross-section of the device of FIG. 4 with the embossed medium.

FIG. 3 is the same as FIG. 1, and corresponding parts are designated by the same reference numerals. FIG. 3 schematically indicates a certain toothing where the individual teeth are again in the form of truncated pyramids, as cited above, but instead of being parallel resp. perpendicular to the longitudinal axes of the embossing rolls, the sides of the pyramids are disposed at any angle a thereto, e.g. 45°.

The device according to FIGS. 1 to 3 is especially suitable for applications where the engravings are provided on driven roll 2 and the two mating rolls only have toothings without engravings. Furthermore, this device is preferred in cases where the material is subject to very little or no distortion in order to avoid blurring of the contours.

If it is intended to provide engravings both on one of the embossing rolls, e.g. on the driven roll, and on one or even both of the mating rolls, on one hand, and/or if there is a risk that the paper is subject to strong distortions between the two mating rolls, it is advantageous and sometimes even imperative to permanently synchronize the rolls to each other. In the second embodiment according to FIGS. 4 to 7, driven roll 10, the first mating roll 11, and the second mating roll 12 in device 9 are mutually synchronized by gearwheels 13, 14, and 15. The gearwheels generally represent synchronizing elements comprising other synchronizing means which are known per se, such as electronic components and the like.

The synchronization allows a precise embossing in the above-mentioned, complex cases. Here also, essentially, the embossed material is pre-embossed by the first mating roll, and the re-embossing is subsequently performed by the second mating roll in order to neutralize most of the remaining residual tension in the medium. If possible, the re-embossing is set into the pre-embossing, i.e. if engravings are provided both on the first mating roll and on the following mating rolls, the area of the contours on the first mating roll may be somewhat more comprehensive than on the following mating roll in order to obtain an improvement of the contour.

The support of the roll axles, the contact of the mating rolls on the driven roll or on the preceding roll, as well as the application of the engravings remain the same as in the previous example, but the synchronization allows further possible applications. One or both, resp. all or some of the mating rolls may have engravings which are inverted with respect to those of the driven roll, i.e. the driven roll may have positive (negative) and the mating roll(s) may have positive (negative) engravings.

Here also, the embossing rolls need not have the same diameter or the same length, but in contrast to the first example, unless they are equal, the ratio of the roll diameters must be integral if the synchronization is effected by gearwheels, whereas their lengths may be different individually.

Figure 6:
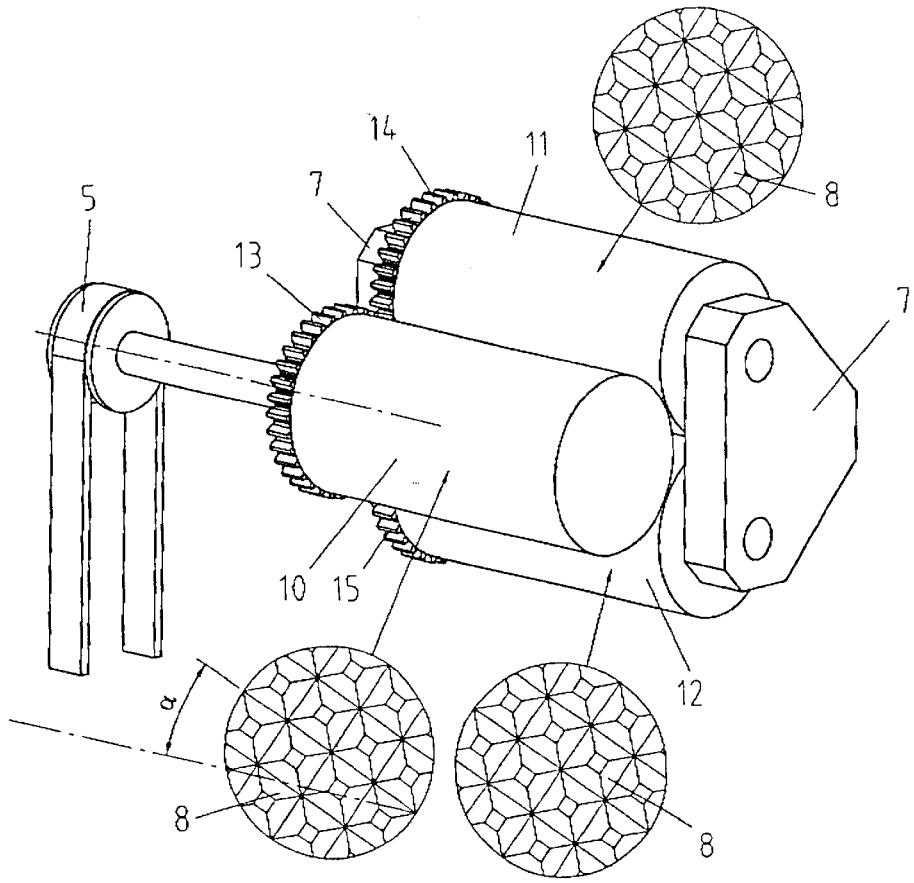
FIG. 6 shows the device of FIG. 4 with enlarged details of toothings.

FIG. 6 shows the same toothing of the rolls as illustrated in FIG. 3.

Figure 7:
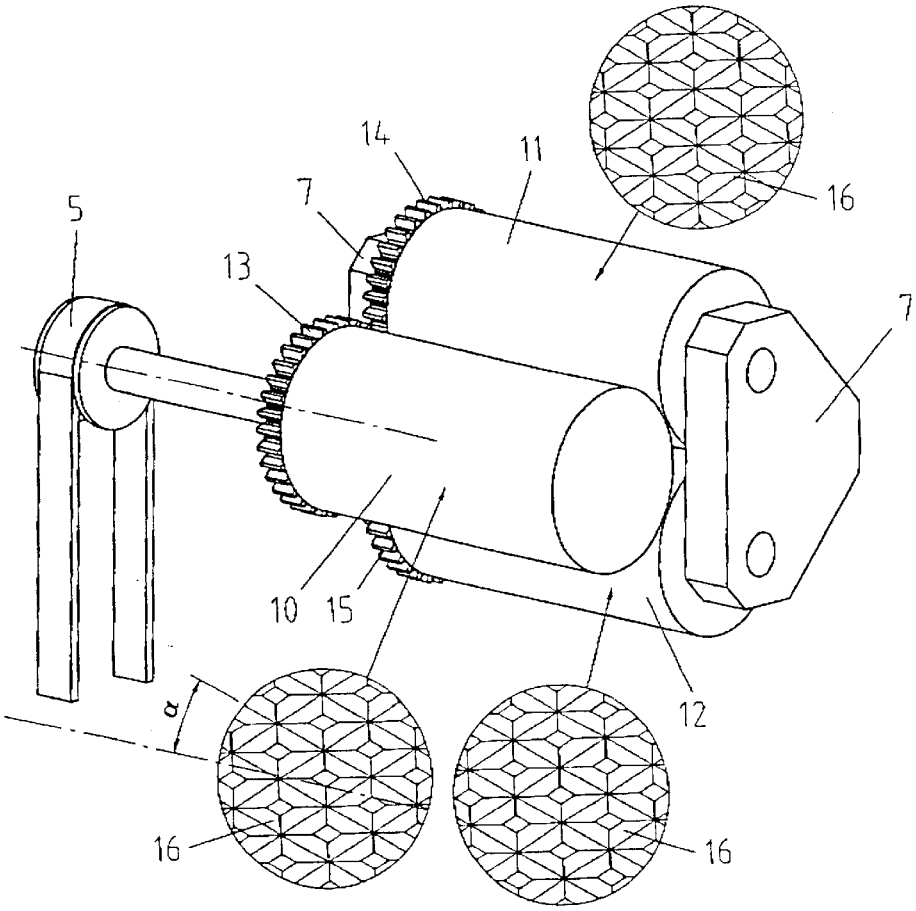
FIG. 7 shows the device of FIG. 4 with further enlarged details of toothings.

FIG. 7 shows a toothing with teeth 16 which consist of pyramids having a rhombic base and whose lateral surfaces are arranged in parallel or at any angle to the longitudinal axis of the rolls. Furthermore, the teeth may also be in the form of truncated conical bodies.

The European Patent Application No. 99810255.2 of the same applicant, which is herewith expressly referred to, discloses an embossing device where at least one of the embossing rolls is contained in an interchangeable unit such that it is insertable in the bearing mount in a predetermined position.

For the present device, which includes at least three embossing rolls, interchangeable units for individual rolls or groups of rolls are particularly advantageous since the rationalization effect and the ecological advantages are particularly important in this case.

The preceding description shows that the device of the invention offers many advantages:

1. The paper fibers are broken in the best possible manner and the memory effect of the paper is largely neutralized. This is possible by a precise positioning of the successive embossing rolls in operation, thereby allowing to re-emboss even very fine existing embossing patterns without optical deterioration.

2. The better folding behavior of the surrounding packing foils eliminates problems in inserting pre-folded packaging units into boxes.

3. The reject rate is reduced, thus improving the efficiency of the packaging machine.

4. The productivity of packaging machines is increased due to a higher manufacturing cadence on account of improved packaging and operating performance.

5. Reduced wear of the embossing rolls, thereby allowing reduced costs for spare parts and machine standstills.

6. The tolerance range in the quality inspection of the paper is enlarged, thus increasing the number of possible manufacturers.

7. An ecological manufacture is ensured by a longer tool life of the embossing rolls, a reduced reject rate, and shorter machine standstills.

8. An advantageous construction allows shorter changeovers between embossing patterns and between embossing rolls and thus shorter standstill times of the packaging machine.

9. The manufacturing process largely allows to neutralize curling of the embossed medium after the first embossing of the paper. According to the present invention, this is attained by re-embossing the pattern.

10. The device allows to design an embossing machine whose embossing roll construction requires no flexural compensation of the rolls.

What is claimed is:

1. A device for embossing and calendaring a foil comprising:

a first roll and a second roll configured to pass the foil under pressure between them to produce at least one pattern on the foil in a sub-millimeter range of pitch and depth and to provide the surface of the foil with a smooth or glossy finish, the first roll and second roll having identical toothings, wherein in a stabilized condition a tooth of one of the first roll and the second roll is situated between four adjacent teeth of the other of the first roll and second roll, and wherein one of the first roll and the second roll is driven and the other of the first roll and the second roll is free-wheeled; and at least a third roll following the second roll, the third roll cooperating with one of the first roll and second roll to receive and pass the foil to re-emboss the foil with essentially the same pattern as produced from the first roll and second roll.

2. The device of claim 1, wherein said embossing rolls are mutually synchronized by means of synchronizing means.

3. The device of claim 1, wherein the second free-wheeled roll is journalled such as to be capable of an excursion in one or more of: the longitudinal direction of the axle, the pressure direction, and the traveling direction of the embossed material.

4. The device of claim 1, wherein the device includes more than one free-wheeled embossing roll that are journalled so as to travel individually, in groups, or in common.

5. The device of claim 1, wherein an engraving is provided on the driven embossing roll.

6. The device of claim 1, wherein an engraving is provided on the free-wheeled embossing roll.

7. The device of claim 6, wherein the device includes more than one free-wheeled embossing roll and embossing pressure is adjusted to be the same on all free-wheeled embossing rolls, individually on each embossing roll, or in groups or in common, and differently varied.

8. The device of claim 1, wherein the device includes one or more free-wheeled embossing rolls, each provided with an engraving which is inverse to an engraving on the driven embossing roll.

9. The device of claim 8, wherein each free-wheeled roll is provided with the inverse engraving of a preceding embossing roll.

10. The device of claim 1, wherein the device includes one or more free-wheeled embossing rolls, each provided with an engraving of the same kind as that provided on the driven embossing roll and whose surface area is equal to or greater than that of an engraving on the driven embossing roll.

11. The device of claim 1, wherein one or both of the first and second rolls are provided with an engraving, and is/are unsynchronized with the third roll.

12. The device of claim 1, wherein the first, second and third rolls are synchronized with each other.

13. The device of claim 1, wherein one or more of the first, second, and third rolls are provided with an engraving and are disposed in an interchangeable unit individually, in groups, or in common.

14. The device of claim 1, wherein the first, second and third rolls are adapted to emboss and calendar metallic foils or foils having at least one metallic layer.

15. The device of claim 1, wherein the teeth of the embossing rolls intermesh to self-synchronize the driven and free-wheeled rolls.

16. The device of claim 1, wherein the teeth of said first and second embossing rolls are disposed parallel and perpendicular to the longitudinal axes of the embossing rolls.

17. A device according to claim 1, wherein the first, second and third rolls are configured to emboss and calendar a foil comprising a fibrous material covered with a metal film.

* * * * *